United States Patent [19]

Furutsu

[11] Patent Number: 4,511,073

[45] Date of Patent: Apr. 16, 1985

[54] FASTENER DISPENSING DEVICE

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 401,181

[22] Filed: Jul. 23, 1982

[51] Int. Cl.[3] ..... B25C 1/00

[52] U.S. Cl. ..... 227/67

[58] Field of Search ..... 227/67; 226/156, 157

[56] References Cited

U.S. PATENT DOCUMENTS

| | | | |
|---|---|---|---|
| 2,290,041 | 7/1942 | Gautier | 226/157 |
| 3,050,226 | 8/1962 | Parrella | 226/157 |
| 3,677,452 | 7/1972 | Wallace | 226/157 |
| 3,888,402 | 6/1975 | Bone | 226/157 |
| 4,310,962 | 1/1982 | Suzuki | 227/67 |

*Primary Examiner*—Donald R. Schran
*Assistant Examiner*—James Wolfe
*Attorney, Agent, or Firm*—Blum Kaplan Friedman Silberman & Beran

[57] ABSTRACT

A fastener dispensing device having an improved fastener feeding mechanism. The feeding mechanism includes a friction wheel rotatably supported on the device adjacent the guide groove for the fastener assembly and abutting against the connection necks of the fasteners. A support plate is mounted coaxially with the friction wheel and is adapted to pivot when the operation lever of the device is pivoted. A wheel driving member is pivotably supported on the support plate and includes a projecting portion which selectively engages the friction wheel with the projecting portion engaging and rotating the friction wheel when the operation lever is pivoted to cause the friction wheel to move the fastener assembly so that the next fastener is moved to a prescribed discharge position to be pushed through the hollow needle of the dispensing device.

7 Claims, 10 Drawing Figures

FASTENER DISPENSING DEVICE

BACKGROUND OF THE INVENTION

1. Field of the Invention

The present invention relates to a fastener dispensing device of which the overall configuration and the function generally resemble a pistol-type gun and with which a plurality of filament-shaped fasteners molded from a synthetic resin in the form of an integral assembly and loaded assembly by assembly in the device are successively dispensed relative to a variety of objects one at each time of the operation. More particularly, the invention relates to a fastener dispensing device of the mentioned type which is improved in that even in case of a change in the pitch of the individual fastener arrangement in fastener assemblies, it can without fail dispense individual fasteners successively one at a time of the operation of the device.

2. Description of the Prior Art

Today widely utilized among for example manufactures/retailers of fabric-made goods are filament-shaped fasteners which are molded from a synthetic resin such as nylon or polypropyrene for example and which are dispensed typically for attaching tags, labels or the like to various items of merchandise or for arranging a plurality of objects in pair assortments or securing any groups of objects to one another. Now that they are utilized typically in attaching tags or the like, for example price tags, the fasteners in reference are broadly also called tagging pins or tag pins.

These tag pins, namely fasteners, individually comprise a filament having a head and a crossbar at one and the other ends thereof. The filament also has a connection neck protruded beyond the crossbar in the direction away the head, and through the connection neck of respective pins, a prescribed number of pins are integrally arranged on a carrier rod like teeth of a comb, to comprise an integral assembly of fasteners. While fasteners are thus manufactured and supplied in the form of assemblies, this is for reasons of a convenience met in the manufacture, an easiness realized for the packaging and transportation, and also a high efficiency attained of the manipulation or dispensing, of fasteners, and normally 20 to 50 pins are arranged on a single carrier rod of a fastener assembly. Further, for reasons of conveniences in the fabrication of molds and also the loading and dispensing of fasteners in and through a dispensing device, pins or fasteners are formed at a pitch normally of the order of 2 mm on the carrier rod.

Fasteners manufactured by molding and supplied as above are loaded in a dispensing device assembly by assembly, and when the dispensing device is operated, they are individually successively severed one at a time of the operation and applied to objects in a manner such that a part of the fastener is pierced through the object and anchored thereto.

One form of the device with which to dispense fasteners as above is disclosed in the U.S. Pat. No. 4,090,653 (Akira Furutu). As disclosed in the patent, the general configuration or structure of the device resembles a gun or pistol as before mentioned and in respect also to its function, the device may well be likened to a gun in that it includes an operation lever resembling a trigger in the gun, which may be put for a pulling operation to let a fastener be pierced, if not completely, through an object like a bullet in the case of the gun.

In greater detail, the fastener dispensing device comprises a structural main body, which has a side-slotted hollow needle removably mounted at the nose thereof, and an operation lever or a trigger which is operable to rock relative to the main body. Behind the tail end of the hollow needle, the main body is formed with a guide groove, into which a fastener assembly is loaded and within which individual fasteners of the loaded fastener assembly are successively fed to the prescribed discharge position which is, broadly speaking, aligned with the hollow of the hollow application needle. When the trigger is pulled by gripping, a first fastener which has been fed to the prescribed discharge position within the main body becomes detached from the next following fastener of the loaded fastener assembly and, through the needle that has previously been applied through an object, applied to the object in a manner such that its crossbar reaches the far side of the object.

In conventional fastener dispensing devices and as is the case with the apparatus disclosed in the United States patent above referred to, the fastener feeding mechanism which, upon completion of the dispensing of a first fastener, feeds a second pin to the prescribed discharge position, makes use of a ratchet wheel or gear and comprises a structure such that with the teeth of the ratchet wheel mesh engaged between adjacent connection necks on the carrier rod of the fastener assembly, the ratchet wheel is rotated a tooth distance at each time of the rocking operation of the trigger to thereby effect feeding of fasteners.

As before stated, the interval between each adjacent fasteners on a carrier rod is fixed at a certain value, for example 2 mm, but it has of late been increasingly demanded that there should be supplied a variety of fastener assemblies varied in such inter-fastener interval or pitch. This is because, in practice, to provide a fastener assembly having a denser arrangement of its member fasteners only requires a smaller mold, which can be of an accordingly reduced thermal capacity, with which an advantage can be attained in the light of the thermal economy, and also because smaller molds can be fabricated at a reduced cost. Further, with an assembly of fasteners of which the filament is considerably great in length, it is necessary to enlarge the inter-fastener pitch.

When the pitch of the fastener arrangement in the fastener assembly is changed as above or, in other words, when it is required to manipulate a variety of fastener assemblies which have different pitches of the fastener arrangement or, more accurately, the arrangement of connection necks, an inconvenience is encountered with the existing fastener dispensing devices or, more specifically, the fastener feeding mechanism thereof. That is to say, the fastener feeding mechanism of the conventional dispensing device utilizes a gear the tooth pitch of which is adapted to the pitch of the interconnection neck of a given fastener assembly, so that when a fastener assembly of a different connection-neck pitch is given for manipulation, the existing gear can no longer be effectively operated to feed fasteners. For example, with a fastener dispensing device of which the fastener feeding mechanism is adapted to manipulation of fastener assemblies having a pitch of connection necks of the order of 2 mm, this cannot be effectively employed for dispensing fasteners arranged in a pitch essentially greater or smaller than 2 mm. A same as above is applicable also in case where a given fastener assembly involves an irregularity in the inter-connection neck pitch possibly attributable to an accidental error in the manufacture of the fastener assembly.

SUMMARY OF THE INVENTION

Therefore, it is a primary object of the present invention to eliminate the indicated inconvenience or shortcoming with the existing fastener dispensing apparatus.

Another object of the invention is to provide an improved fastener dispensing device which can without fail dispense individual fasteners of a loaded fastener assembly successively one at a time of the operation even in case of a change or an irregularity present in the pitch of connection necks of the fastener assembly.

A still another object of the invention is to provide an improved fastener dispensing device having a fastener feeding mechanism which can without fail feed to the prescribed discharge position within the device individual fasteners of a fastener assembly loaded in the device successively one fastener at a time of the operation of the device even in case of a change or an irregularity in the pitch of connection necks of the fastener assembly.

These objects are attained according to the present invention broadly by providing a device for dispensing successively one at a time of the operation thereof a plurality of fasteners to be loaded in the form of an integral fastener assembly, which comprises a main body having a side-slotted hollow needle removably mounted at a front end or nose part thereof and formed at a part thereof behind the tail end of the needle with a guide groove for receiving and guiding the fastener assembly therein, extending perpendicular to the axis line of the needle, an operation lever operable to rock relative to the main body, and a pushing rod to be driven into the hollow needle through operation of the lever to dispense fasteners relative to objects in a manner such that the pushing rod drives the crossbar of the fastener through the hollow needle preparatively applied through an object, and which further comprises a fastener feeding mechanism for delivering fasteners of a loaded fastener assembly successively one at a time of the operation of the lever to the prescribed discharge position within the main body, which mechanism is improved in that it comprises means adapted to abut against the connection neck of the fastener and, through the resulting friction force, advance the carrier rod of the fastener assembly, whereby regardless of a change or an irregularity present in the pitch of the connection necks of the fastener assembly individual fasteners can be fed without fail one at a time of the operation of the operation lever.

In a preferred form of the invention, the fastener feeding mechanism may comprise a friction wheel rotatably mounted inwardly beside the guide groove and adapted to abut against the connection necks of respective fasteners, a support plate capable of being rocked with the center of rotation of the friction wheel as the center of its rocking motion when the operation lever is manipulated, and a wheel driving member mounted on the support plate and having a projection portion to be driven to come into and out of contact engagement with the friction wheel and drive the latter for rotation, wherein an arrangement is made such that when the operation lever is operated, the projection portion of the wheel driving member is brought to abut against the friction wheel and the wheel driving member is rocked together with the support plate with the rotatory center of the friction wheel as the fulcrum of the rocking motion thereof to rotate the friction wheel, to thereby advance the carrier rod each time a distance corresponding to a single inter-connection neck pitch.

In the above fastener dispensing device, it may also be advantageous according to the present invention to devise that in order to enhance the degree of the abutment performance of the friction wheel against the carrier rod of the fastener assembly the provision is made of a rocker plate which actuates the friction wheel toward the carrier rod, through an elastic means, in which the friction wheel may be rotatably supported by the rocker plate.

These and other objects, features and advantages of the present invention will become apparent from considering the following description of the preferred embodiments of the invention taken in conjunction with the accompanying drawings.

DESCRIPTION OF THE PREFERRED EMBODIMENTS

Before a detailed description is entered of the fastener dispensing device according to the present invention per se, it is herein proposed for purposes of facilitating a fuller understanding of the invention to initially give a glance at the existing fastener, fastener assembly and fastener dispensing device, which are illustrated in FIGS. 1 through 4.

Figure 1:
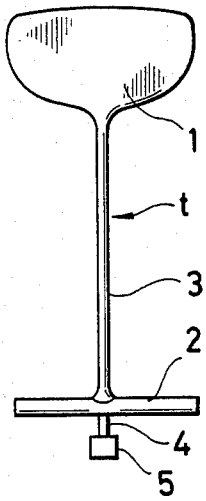
FIG. 1 is a front view, showing an example of the fastener assembly, often referred to also as tag pin assembly.
Figure 2:
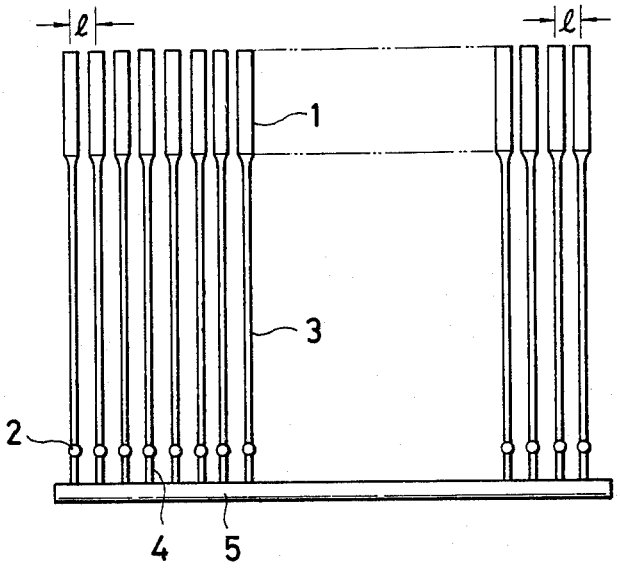
FIG. 2 shows a side elevational view of FIG. 1.

Thus, a reference may be had to FIGS. 1 and 2 at the outset. As shown, each fastener which may typically comprise a tag pin and is indicated at t consists of a head 1 which stops for example a price tag thereat, a crossbar 2 which is applied through an object for example a fabric-made article and anchored at the far side of the object, and a filament 3 which integrally connects the head and the crossbar and has a connection neck 4 comprising an extended end portion thereof protruding beyond the crossbar in the direction away the head. A plurality of such individual fasteners are arranged in series on a carrier rod 5 through their respective connection necks 4 to altogether comprise a fastener assembly T, resembling the arrangement of teeth of a comb.

Figure 3:
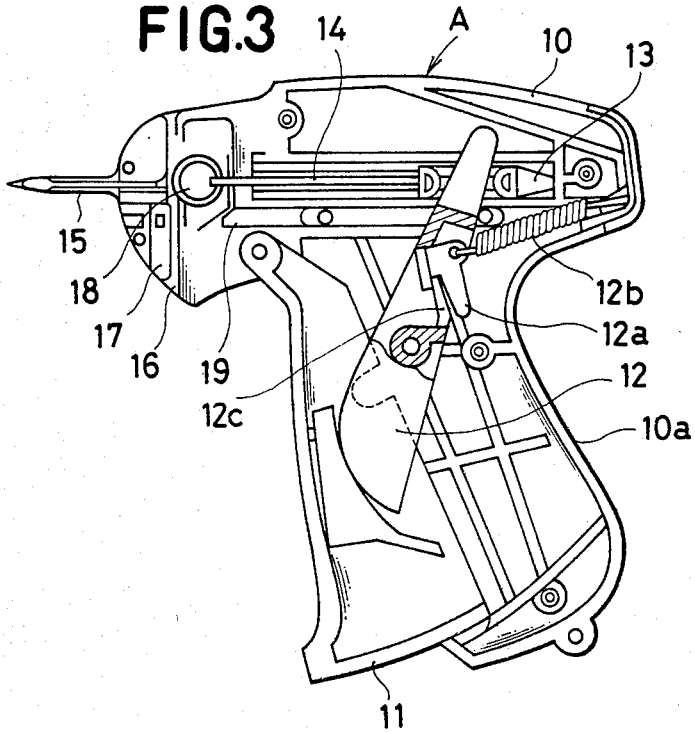
FIG. 3 is a side elevational view, in section, of a conventional fastener dispensing device, taken also for an illustration of the overall structure of pistol-type dispensing devices.

FIG. 3 shows at the letter A a typical example of conventional devices for therein loading fasteners t assembly by assembly thereof T and dispensing the fasteners relative to various objects. As shown, this device A comprises a main body 10 having a grip part 10*a*, and an operation lever or trigger 11 which is operable to rock in directions toward and away the grip 10*a*. When the lever 11 is pulled, the motion thereof is transmitted through an intermediate lever 12 and a slider 13 to a pushing rod 14, which is moved toward a side-slotted hollow needle 15 to drive into the needle 15 the crossbar 2 of a fastener t which has been preparatively fed to the prescribed discharge position behind the tail end of the needle, of which the leading end has been preparatively applied through an object. When the crossbar 2 is passed through the needle a distance enough to reach the far side of the object, the needle may be pulled out of the object to leave the fastener anchored to the object. Needless to mention, a price tag or the like which is to be fastened to the object by the fastener is to be received, for example through a hole formed thereof, on the hollow needle before the latter is applied through the object.

At a front end portion of the main body 10, the device A has a guide groove 16 formed closely behind the tail end of the needle 15, extending perpendicular to the axis line of the needle, and in this guide groove, a fastener assembly T is loaded. Then, the carrier rod 5 of the fastener assembly is fed downwardly in the groove 16, and when the crossbar 2 of a first fastener t is driven into the hollow of the needle 15, that fastener is cut at a portion of its connection neck 4 against a cutter blade 17 incorporated in the device A.

Figure 4:
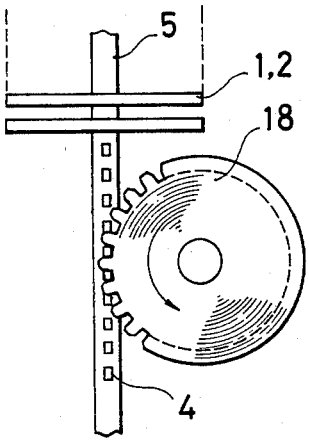
FIG. 4 shows a side view, in enlargement, of the fastener feeding mechanism in conventional devices.

In the conventional fastener dispensing apparatus A broadly of the foregoing structural and operational features, the fastener feeding mechanism comprises a gear 18, as shown in FIG. 4. The gear 18 is mesh engaged between connection necks 4 arranged in series on the carrier rod 5 of the fastener assembly T, and accompanying rocking motions of the lever 11 made by gripping and releasing thereof, a ratchet member (not shown) is driven through a cam mechanism (not shown) to intermittently rotate the gear 18 a tooth distance a time.

As previously stated, the distance between each adjacent fasteners t on the carrier rod 5 or the interfastener pitch l is normally about 2 mm, therefore the comparable distance between connection necks 4 or the interneck portion pitch is also about 2 mm, normally. Also as before mentioned, however, today manufactured and supplied are a variety of fastener assemblies widely varied in the inter-fastener pitch or inter-neck pitch l.

With the above fastener feeding mechanism in the today apparatus for dispensing fasteners, the feeding or sending of the fastener assembly is made with the teeth of gear 18 engaged with adjacent connection necks 4 of fasteners, so that with fastener assemblies of different inter-neck pitches, they cannot be effectively engaged by the gear 18. That is to say, in order to manipulate fastener assemblies diversified in the inter-neck pitch thereof with a single dispensing device, it is necessary to beforehand provide for gears accordingly diversified in the tooth pitch and carry out exchange of gears selectively. This is extremely detrimetal to the fastener dispensing operation.

The present invention can effectively cancel such difficulties in a simple manner, and it will now be put for a detailed description with reference to its specific embodiments, which is entered in the sense solely of an illustration.

Figure 5:
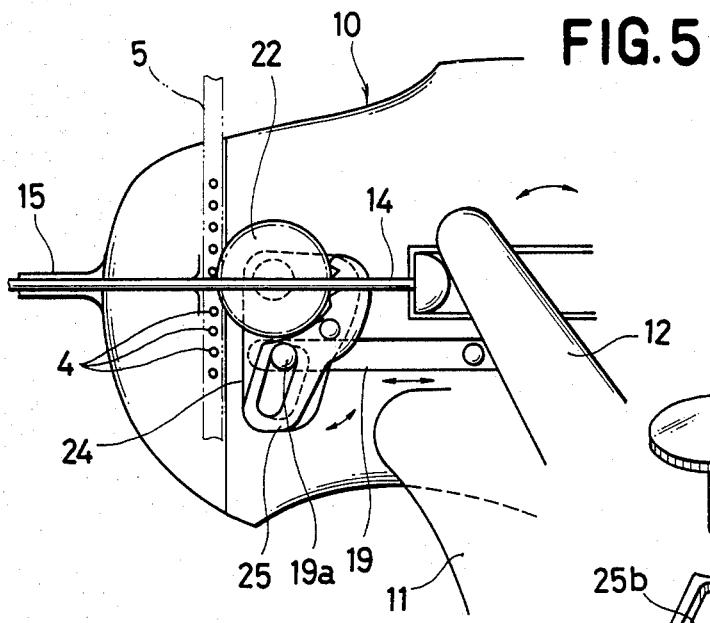
FIGS. 5 and 6 are respectively a side view, showing an example of the fastener feeding mechanism embodying the present invention.

FIG. 5 shows a side elevational view of essential portions of a first embodiment of the invention, and it shows an operation condition in which the dispensing of a first fastener has been accomplished, while in FIG. 6 which is a similar view to FIG. 5, a different operation condition is illustrated, in which the carrier rod of a loaded fastener assembly is being fed or sent toward below after the condition shown in FIG. 5 has been reached. Identical reference characters as in FIG. 3 denote in FIGS. 5 and 6 identical members and/or parts as in FIG. 3. Further, in the perspective view of FIG. 7 there are shown a friction wheel, a wheel driving member and a support plate, which altogether constitute essential members in the first embodiment of the invention.

Figure 6:
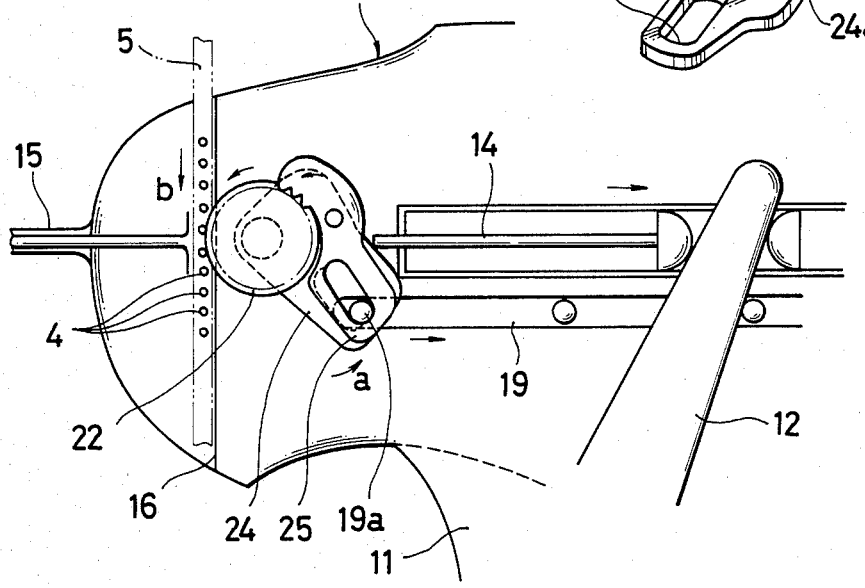

As shown in FIGS. 5 and 6, a friction wheel 22 is rotatably mounted inwardly beside the guide groove 16 formed at a front end portion of the main body 10. This wheel 22 is so mounted as to abut against connection necks 4 arranged in series on the carrier rod 5 and, through the friction force then generated, feed or advance the carrier bar 5. While in the illustrated example, the wheel 22 is formed on its outer peripheral face with a number of teeth of a pitch finer than that of the connection necks 4, those teeth may be replaced by fine bevel lands and grooves by knurling. Further alternatively, the friction wheel 22 may be so structured as to wholly comprise a material having a high friction coefficient such as rubber for example, or comprise a peripheral face having such material bonded thereto. By the employment of this friction wheel 22, an efficient feeding of the fastener assembly can be made even if fastener assemblies different in the pitch of necks 4 are to be manipulated.

Further, in the first embodiment of the invention under consideration, a support plate 24 is rockably mounted, coaxially with the friction wheel 22.

Figure 7:
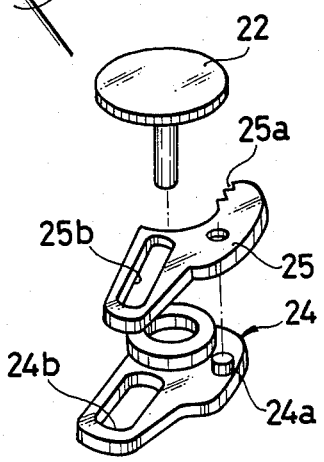
FIG. 7 is a perspective view, illustrating disassembled friction wheel, wheel driving member and support plate of the feeding mechanism of FIGS. 5 and 6.

As best seen in FIG. 7, at a central portion on one side (the right side in FIG. 7), the support plate 24 is provided with a pin 24*a*, by which a wheel driving member 25 is rockably supported. An upper side face portion of the wheel driving member which faces the peripheral face of the friction wheel 22 is curved in a concavity complemental to the circular peripheral face of the wheel 22, and is formed with a projection portion 25*a* having pawl-like projections, which engage the fine teeth on the peripheral face of the wheel 22, if so formed.

The support plate 24 is formed in a lower portion thereof with a slit 24*b* elongate in a vertical direction (FIG. 5). Similar to this, the wheel driving member 25, too, is provided at a lower portion thereof with similarly vertically elongate slit 25*b*. Slits 24*b* and 25*b* are substantially identically elongate, but in the width, slit 24*b* is greater than slit 25*b* as clearly seen from FIG. 7 so that the wheel driving member 25 can be rotated relative to the support plate 24.

Then, fitted in the slits 24*b* and 25*b* is a projection 19*a* mounted at a front side portion of a slide bar 19 which is driven in forward and backward directions by the intermediate lever 12, and through such motion of the slide bar 19 the support plate 24 and wheel driving member 25 are driven to rock.

Further, reverting to FIG. 3, the intermediate lever 12 has a guide wall 12*c*, on which a spring support 12*a* is slidably supported. To the support member 12*a*, one end of a spring 12*b* is connected, of which the other end is secured to a cover member removably mounted at the rear end of the main body 10. The lever 12 is pivotally supported so that by the force of the spring 12*b*, it normally is actuated with its lower end to come out of the grip 10*a*. In the condition shown in FIG. 3 in which the lever 11 is in its normal or initial free condition, the spring support member 12*a* is located at the uppermost position on the guide wall 12*c* and the spring 12*b* is in its most contracted state. When the lever 11 is then gripped, the intermediate lever 12 is rotated in the counterclockwise direction to thrust a fastener out of the needle through the pushing rod 14, when the spring support member 12*a* moves to its lowermost position on the wall 12*c* so that the spring 12*b* may not undergo an excessive expansion, whereby the requirement of any large force can be effectively avoided for the operation of the lever 11.

In operation, upon completion of the manipulation of a first fastener (FIG. 5), the trigger 11 may be liberated from gripping or pulling, upon which the slide bar 19 becomes retracted toward the right in FIG. 5 by the intermediate lever 12. Accompanying this retracting motion of slide bar 19, the projection 19*a* thereon mounted moves in the slit 25*b* in abutment against one side edge thereof and the wheel driving member 25 is rotated with the pin 24*a* as the fulcrum for rotation, to engage with its projections 25*a* the finely toothed periphery of the friction wheel 22. In this condition, the wheel driving member 25 is rotated together with the support plate 24 in the direction shown by an arrow a in FIG. 6 about the center of rotation of the friction wheel 22, whereby the wheel 22 is rotated in the same direction as above to advance the carrier rod 5 of the loaded fastener assembly in the direction of arrow b in FIG. 6.

As stated above, the wheel driving member 25 is rotated about the pin 24*a* so that its projection portion 25*a* can be brought to engage the friction wheel 22, and under such condition, the driving member 25 is rotated about the rotation center of friction wheel 22, that is, it is driven to move on the periphery of the wheel 22, whereby the projections 25*a* can engage the friction wheel 22 in a manner of biting in the periphery of the wheel and rotate with the wheel, so that the wheel 22 can be rotated without fail.

Then, in entering manipulation of a second fastener upon completion as above of the operation for advancing the carrier rod 5 toward below in FIG. 6, the trigger 11 is pulled, whereupon the slide bar 19 is moved forward and accompanying this, the projection 19*a* moves in the slit 25*b* in abutment against the other side edge thereof, whereby the wheel driving member 25 is rotated with the pin 24*a* as its rotation center in a direction away the friction wheel 22. Thus, the projection portion 25*a* of member 25 is disengaged from the wheel 22, and under this condition, the wheel driving member 25 is rotated, together with the support plate 24, about the center of rotation of the friction wheel 22 in the opposite direction of the arrow a in FIG. 6. Thus, at the time a second fastener is manipulated for dispensing, the projection portion 25*a* is first disengaged from the friction wheel 22, so that the inconvenience can be effectively avoided of the wheel 22 being allowed to rotate in the direction opposite that shown by arrow a in FIG. 6.

Figure 8:
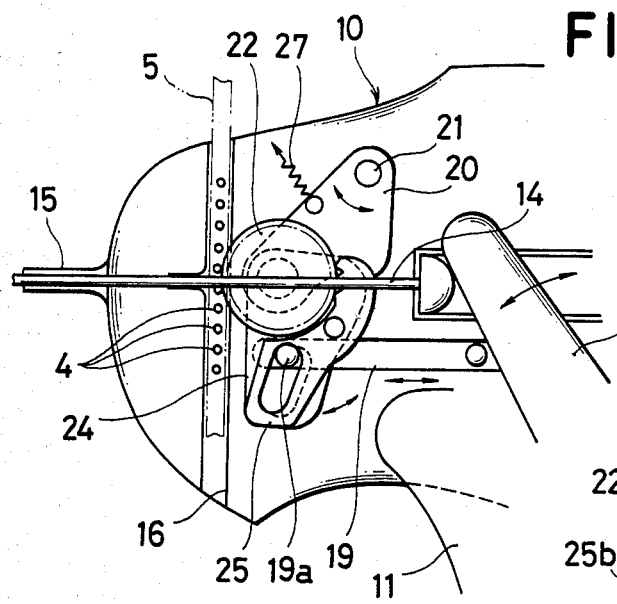
FIGS. 8 and 9 show, in side elevational views, a modified example of the fastener feeding mechanism, representing a second embodiment of the present invention.
Figure 10:
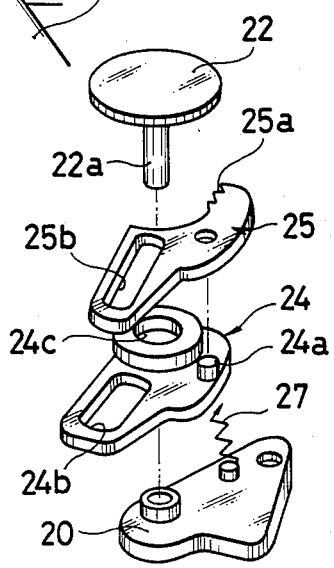
FIG. 10 is a perspective view, showing disassembled friction wheel, wheel driving member, support plate and rocker plate in the feeding mechanism shown in FIGS. 8 and 9.
Figure 9:
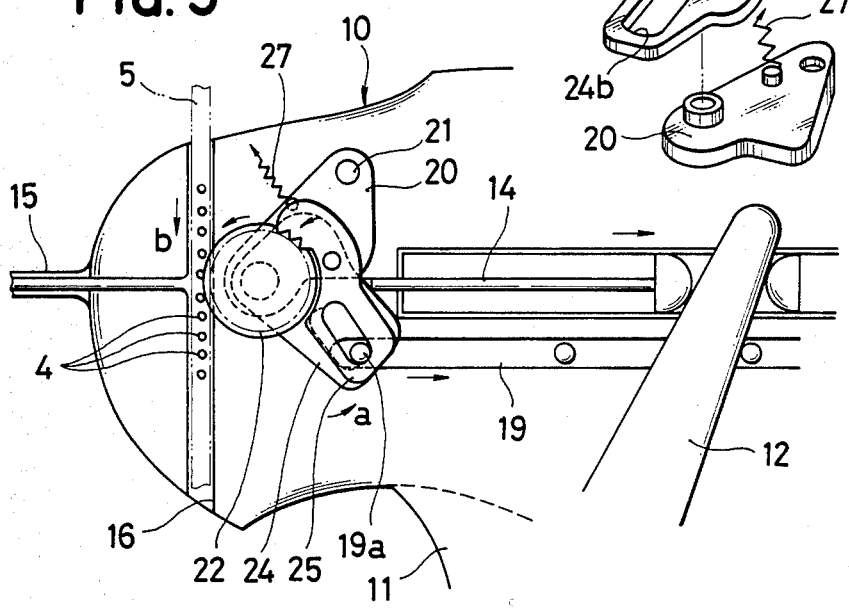

FIGS. 8 through 10 show similar views to FIGS. 5 through 7 considered above, respectively, but represent another preferred embodiment of the present invention.

According to this second embodient of the invention, the pistol-shaped main body 10 incorporates, in a portion thereof inwardly beside the fastener guide groove 16, a rocking plate 20, which is pivotally supported by a pin 21 and on which the friction wheel 22 is rotatably mounted. This rocker plate 20 is biased through spring means or a coiled spring 27 toward the guide groove 16 or connection necks 4 on the carrier rod 5 of the loaded fastener assembly. That is to say, the friction wheel 22 is in the present embodiment both rotatable and elastically movable toward the fastener assembly loaded in the apparatus.

The peripheral surface of the wheel 22 may be processed in a same manner as before described with reference to FIGS. 5 through 7, while the wheel 22 is adapted in the present embodiment to more positively abut against connection necks 4 of the fastener assembly by the spring force applied by the elastic means 27, and through the resulting friction, it functions to feed or advance the carrier bar 5 of the fastener assembly as it is rotated.

The driving mechanism for the friction wheel 22 may be structured as follows so that the wheel can be securely rotated: As shown in detail in FIG. 10 in particular, the support plate 24 is formed with a mounting hole 24*c*, through which a shaft portion 22*a* of the wheel 22 is extended so that the lower end of the shaft 22*a* is received on the rocker plate 20.

It will be readily understood that in respect to both structural features and operational features the second embodiment of the invention being considered closely resembles the first embodiment before considered, except that the spring-biased rocker plate 20 is incorporated in the case of the second embodiment, the plate 20 functioning to elastically forcing the friction wheel 22 toward the fastener assembly.

According to the modified example or second embodiment, the friction wheel is mounted to be elastically movable toward the fastener assembly as stated above, so that the friction engagement between the wheel and the fastener assembly or, more specifically, connection necks of individual fasteners thereof, can take place at an advanced certainty; also, there can be effectively avoided a failure in feeding fasteners which is likely when a change occurs in the pitch of the fastener arrangement in fastener assemblies, and further, regardless how great is the change, if any, in the pitch of connection necks on the carrier bar of the fastener assembly, the friction wheel can be rotated free of a slipping or, on the contrary, a heavy resistance felt by the operator.

Whereas the invention has been described in connection with the two specific embodiments illustrated in the accompanying drawings, this is only by way of illustration of the invention, and it will be apparent to those skilled in the art that various changes and modifications can be effected with ease within the scope of the invention to be defined in accordance with claims which will follow:

I claim:

1. A device for dispensing a plurality of fasteners one at a time for each operation of the device, each said fastener including a filament having a head at one end thereof and a crossbar integrally formed at the other end thereof and also having a connection neck protruding beyond said crossbar away from said head, said fasteners being connected through said connection necks respectively thereof on a carrier bar to form an integral fastener assembly, comprising a main body having a front end including a side-slotted hollow needle removably mounted at said front end and a guide groove formed at the tail end of said hollow needle for receiving and guiding said fasteners loaded in the device, said guide groove extending substantially perpendicular to said hollow needle, an operation lever pivotably coupled to said main body, a pushing rod to be driven into the hollow needle through operation of said operation lever to dispense fasteners through the needle relative to objects in a manner such that the pushing rod drives the crossbar of the fastener through the hollow needle and through an object, and a fastener feeding mechanism for delivering fasteners of a fastener assembly loaded in the device successively one at a time for each operation of the operation lever to a prescribed discharge position within said main body in alignment with said hollow needle, said fastener feeding mechanism including a friction wheel with a smooth peripheral face having a high coefficient of friction rotatably supported on said main body adjacent said guide groove and abutting against said connection necks of said fasteners but not extending therebetween, a support plate mounted coaxially with said friction wheel and adapted to pivot when said operation lever is pivoted, and a wheel driving member pivotably supported on said support plate having a projecting portion which selectively engages said friction wheel, said projecting portion engaging and rotating said friction wheel when said operation lever is pivoted to cause said friction wheel to move said fastener assembly by friction so that the next fastener is moved to said prescribed discharge position to be pushed through said hollow needle.

2. A fastener dispensing device as claimed in claim 1, wherein an elastic means is incorporated, which actuates said friction wheel toward the loaded fastener assembly.

3. A fastener dispensing device as claimed in claim 2, wherein said elastic means comprises a rocker plate and a coiled spring connected with its one end to said rocker plate and with its other end to a wall portion of said main body, said friction wheel being mounted on said rocker plate.

4. A fastener dispensing device as claimed in any of claims 1 through 3, wherein said wheel driving member is curved, in its upper side face portion thereof which faces the peripheral face of the friction wheel, in a concavity complemental to the circular peripheral face of the friction wheel, said projection portion being formed in such curved upper side face portion.

5. A fastener dispensing device as claimed in claim 3, wherein said friction wheel has a shaft portion, which is inserted through a mounting hole formed in said support plate and received with its lower end on said rocker plate, said wheel driving member being rockably mounted on said support plate through a pin provided at a central portion on one side of the latter, and wherein each of the wheel driving member and the support plate is formed in a lower portion respectively thereof with a vertically elongate slit, in which fitted is a projection mounted at a front side portion of a slide bar to be driven to reciprocate in forward and backward directions by an intermediate lever to be rocked by said operation lever, whereby an arrangement is made such that the operation of the operation lever is transmitted successively through said intermediate lever, said slide bar, the support plate and the wheel driving member to let the friction wheel to rotate.

6. A fastener dispensing device as claimed in claim 1, wherein said wheel driving member is rockably mounted on said support plate through a pin projected at a central portion on one side of the support plate, and each of the wheel driving member and the support plate has a vertically elongate slit provided in a lower portion respectively thereof, and wherein a projection mounted at a front side portion of a slide bar to be driven to reciprocate in forward and backward directions by an intermediate lever to be rocked by said operation lever is fitted in said slits of the wheel driving member and the support plate, whereby an arrangement is made such that the operation of the operation lever is transmitted successively through said intermediate lever, said slide bar, the support plate and the wheel driving member to let the friction wheel rotate.

7. A device for dispensing a plurality of fasteners one at a time for each operation of the device, each said fastener including a filament having a head at one end thereof and a crossbar integrally formed at the other end thereof and also having a connection neck protruding beyond said crossbar away from said head, said fasteners being connected through said connection necks respectively thereof on a carrier bar to form an integral fastener assembly, comprising a main body having a front end including a sideslotted hollow needle removably mounted at said front end and a guide groove formed at the tail end of said hollow needle for receiving and guiding said fasteners loaded in the device, said guide groove extending substantially perpendicular to said hollow needle, an operation lever pivotably coupled to said main body, a pushing rod to be driven into the hollow needle through operation of said operation lever to dispense fasteners through the needle relative to objects in a manner such that the pushing rod drives the crossbar of the fastener through the hollow needle and through an object, and a fastener feeding mechanism for delivering fasteners of a fastener assembly loaded in the device successively one at a time for each operation of the operation lever to a prescribed discharge position within said main body in alignment with said hollow needle, said fastener feeding mechanism including a friction wheel formed on its peripheral face with bevel grooves by knurling arranged in a pitch finer than the pitch of connection necks of fasteners and rotatably supported on said main body adjacent said guide groove and abutting against said connection necks of said fasteners but not extending therebetween, a support plate mounted coaxially with said friction wheel and adapted to pivot when said operation lever is pivoted, and a wheel driving member pivotably supported on said support plate having a projection portion which selectively engages said bevel grooves, said projecting portion engaging and rotating said friction wheel when said operation lever is pivoted to cause said friction wheel to move said fastener assembly by friction so that the next fastener is moved to said prescribed discharge position to be pushed through said hollow needle.

* * * * *